US005809607A

United States Patent [19]

Elson et al.

[11] Patent Number: 5,809,607

[45] Date of Patent: Sep. 22, 1998

[54] LONG HANDLED BATH TOWEL AND WASHCLOTH HOLDER

[76] Inventors: Patricia A. Elson, 3064 Ducommun Ave., San Diego, Calif. 92122; Gina Perea, 4116 Bamboo Ter., Bradenton, Fla. 34210

[21] Appl. No.: 690,574

[22] Filed: Jul. 31, 1996

[51] Int. Cl.[6] ..... A47L 13/46

[52] U.S. Cl. ..... 15/231; 15/147.2; 15/210.1

[58] Field of Search ..... 15/147.2, 209.1, 15/210.1, 228, 231

[56] References Cited

U.S. PATENT DOCUMENTS

| | | | |
|---|---|---|---|
| D. 160,415 | 4/1950 | Moser . | |
| 825,400 | 7/1906 | Lightbrown . | |
| 1,287,628 | 12/1918 | Brown . | |
| 1,372,783 | 3/1921 | Smith . | |
| 1,467,086 | 9/1923 | Blomstrom | 15/147.2 |
| 2,068,162 | 1/1937 | Borchers | 15/147.2 |
| 2,262,888 | 11/1941 | Dodge | 15/228 |
| 2,269,424 | 1/1942 | Bernstein . | |
| 2,740,150 | 4/1956 | Wilding . | |
| 2,815,521 | 12/1957 | Winckler . | |
| 2,916,759 | 12/1959 | Smith . | |
| 3,034,165 | 5/1962 | Christian . | |
| 3,428,987 | 2/1969 | Loston . | |
| 3,571,837 | 3/1971 | Weaver . | |
| 5,012,544 | 5/1991 | Verry . | |
| 5,205,012 | 4/1993 | Coley . | |

OTHER PUBLICATIONS

Concepts ADL Inc. Sales Brochure, "Rehabilitation Products", pp. 136–137 (1993).

North Coast Medical Sales Brochure, "Products For The Activities Of Daily Living", pp. 20, 68–69 (1996).

Fred Sammons and J.A. Preston, "Together For The Dawning Of A New Era", *Bathroom Accessories*, p. 210 (1996).

*Primary Examiner*—Terrence Till

*Attorney, Agent, or Firm*—Knobbe, Martens, Olson & Bear, LLP

[57] ABSTRACT

A device for assisting the disabled in drying themselves is disclosed which comprises an elongated handle with a bath towel coupling plate attached to one end. Preferably, the coupling plate includes two slots for accepting the ends of a bath towel. Most preferably, the coupling plate additionally comprises two additional smaller slots for accepting the ends of a wash cloth.

8 Claims, 1 Drawing Sheet

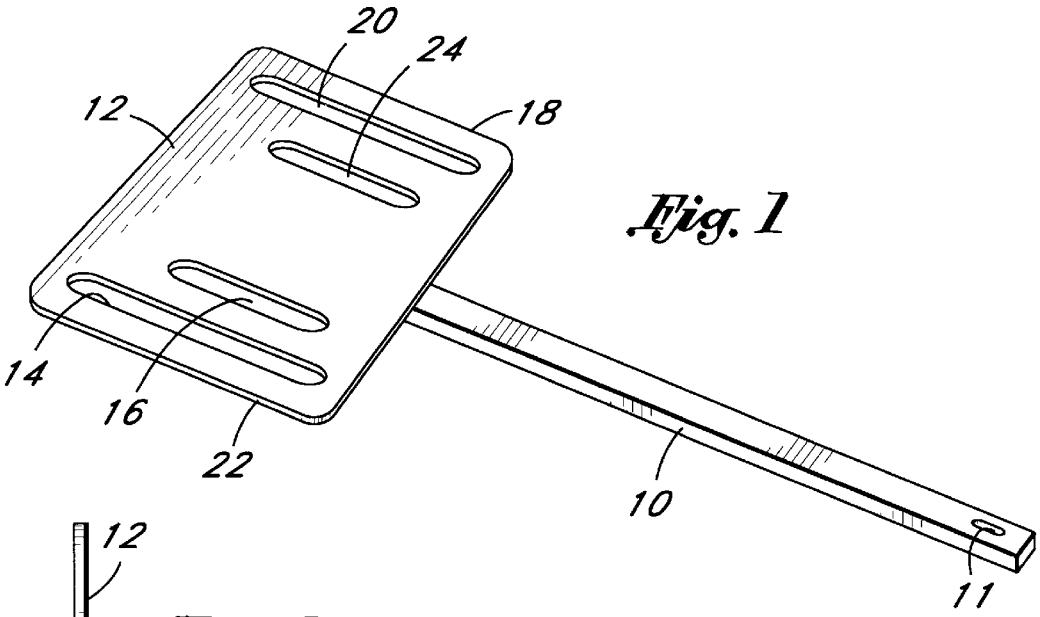
Fig. 1
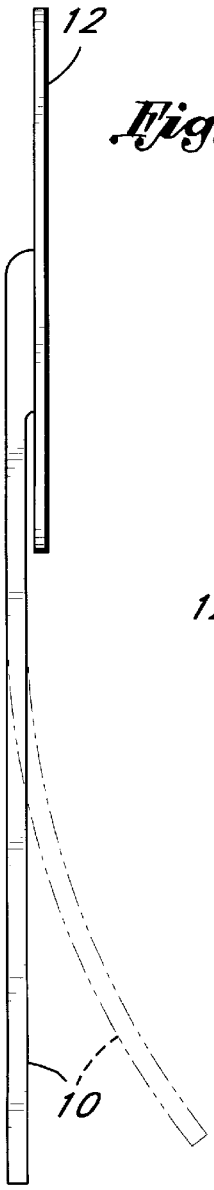
Fig. 2
Fig. 3
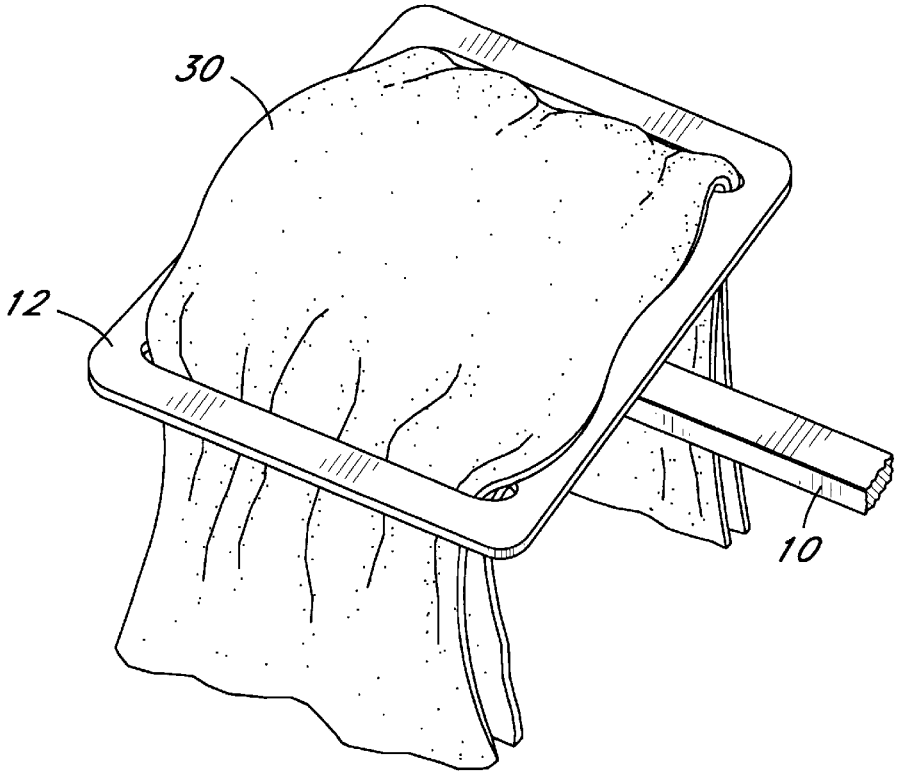

LONG HANDLED BATH TOWEL AND WASHCLOTH HOLDER

DESCRIPTION OF THE RELATED ART

Various devices for the assistance of washing backs, lower legs, and other hard to reach places on the human body have been created. In some cases, such devices have been constructed so as to allow the coupling of an ordinary wash cloth to one end of an elongated handle. One early example is provided by U.S. Pat. No. 1,287,628 to Brown, which discloses a wire clamping apparatus for securing a wash cloth to the sides of a brush head which has an attached elongated handle. Additional washcloth fixation schemes have been more recently devised, as is illustrated by U.S. Pat. No. 5,012,544 to Verry. The device described in this patent includes an elongated handle terminating in a brush head and utilizes flexible straps for wash cloth securement.

Long handled bathing sponges and brushes have also been designed specifically for use by the disabled. These devices generally include a brush or sponge affixed to one end of a handle. In some cases the sponge or brush is removable, and in some cases it is permanently attached. Furthermore, the handles may be made bendable with the application of heat from a portable heat gun.

SUMMARY OF THE INVENTION

As described above, implements designed to assist the disabled in washing themselves without excessive bending and reaching have previously been designed and marketed. However, the desirability of having a device which is useful for drying off after washing without excessive bending and reaching has not been heretofore appreciated. Although drying will take place naturally, it is not always comfortable or convenient to wait for this process to be completed. It is therefore desirable to provide a bathing implement which can be utilized to dry hard to reach areas on a person's body. Preferably, such a device allows the securement of a standard bath towel to one end of an elongated handle. Most preferably, such a device will also allow the securement of a wash cloth so that the device may be used as a washing implement as well.

Accordingly, one aspect of the present invention comprises an apparatus for assisting a disabled person in drying themselves. The device may comprise a bath towel and a rod having first and second ends. The first end of the rod comprises a handle, and the second end of the rod comprises a slotted coupler securing the bath towel to the second end of the handle.

In another aspect of the present invention, the device comprises a handle having a plate attached to one end, where the plate includes at least a first and a second slot. In this aspect, the first slot is proximate to one side of the plate, and the second slot is proximate to the other side of the plate. Furthermore, the first and second slots have dimensions operative to accept a length of bath towel therethrough to hold the bath towel to the plate during drying. In a preferred embodiment, the slots are of substantially equal length and width, with length equal to approximately 3½ to 4 inches and width equal to approximately ½ to 1 inches. The slotted construction allows easy installation of the bath towel onto the coupling plate with the use of only one hand.

The present invention also comprises a device for drying difficult to reach areas of the body after bathing comprising the combination of a plate having first and second parallel and spaced apart elongated slots therethrough, a handle affixed to the plate, and a bath towel having its ends inserted through the slots. In this embodiment, portions of the bath towel are bunched within the slots so that the bath towel is held substantially in place while drying areas of the body. Preferably, the slot dimensions are such that their length to width ratio is approximately 5:1. Most preferably, the bath towel has dimensions of at least about 16 by 30 inches.

Furthermore, the present invention includes a method of drying an object comprising the steps of attaching a bath towel to a coupler affixed to one end of a rod, grasping the other end of the rod, and drying the object with the bath towel. Preferably, the bath towel is attached to the coupler by inserting one end of the bath towel through a first slot in the coupler, and inserting the other end of the bath towel through a second slot in the coupler. A method of completing a bathing routine is also provided by the present invention. This method comprises affixing a washcloth to a portion of a long handled implement and washing parts of a bather with the washcloth followed by affixing a towel to a portion of the long handled implement and drying parts of the bather with the towel.

BRIEF DESCRIPTION OF THE DRAWINGS

FIG. 1 is an overall perspective view of a preferred embodiment of the long handled bath towel holder of the present invention.

FIG. 2 is a side view of the bath towel holder of FIG. 1, illustrating the provision of a bendable handle.

FIG. 3 is a perspective view of the bath towel holder of FIG. 1, showing a bath towel with ends inserted through the slots in the coupler plate.

DETAILED DESCRIPTION OF THE PREFERRED EMBODIMENT

For many individuals, mobility limitations make it difficult to independently complete a bathing routine. Although the elderly are more prone to having difficulty with bathing procedures, there are many causes of such limitations which can affect people of all ages. Some result from surgical procedures such as total hip replacement, which requires orthopedic surgeon precautions that mandate no hip flexion beyond 90 degrees which prevents a patient from drying the lower extremities. Also, hip pinning or ORIF (open reduction internal fixation) or a TKR (total knee replacement) will limit a patient's ability to dry themselves due to post surgical decrease in functional mobility and/or pain. Upper extremity amputations also render the reaching of certain areas of the body difficult or impossible. Other medical conditions also impair the ability to effectively complete bathing routines. For example, CVA (cerebral vascular accidents) may cause hemiparesis to varying degrees of severity resulting in decreased ability to dry oneself due to decreased trunk stability and/or decreased functional mobility of an affected arm or leg. Arthritis may result in decreased joint mobility and increased joint pain, thus limiting mobility and tolerance for bathing tasks. Furthermore, people with cardiac history, vertigo, cerebellar dysfunction, COPD (chronic obstructive pulmonary disease), or generalized weakness due to decreased medical condition require energy conservation techniques such as limiting excessive bending and pacing the rate of task completion during self care tasks. Assistance for people with these and similar conditions may be received with the use of various long handled tools which, for example, can be used to help in dressing, grooming, and also bathing. Bathing related implements, however, have been limited in scope to usefulness in washing. A tool for drying after washing had not been contemplated prior to the present invention. In addition to providing assistance in completing a bathing routine, a preferred embodiment of a drying implement according to the present invention saves time for rehabilitation care givers, reduces sanitation problems, and reduces rehabilitation care costs by allowing the use of separately launderable washcloths and towels. Accordingly, a preferred apparatus for assisting the disabled or otherwise mobility limited persons in drying themselves after washing is disclosed, and is illustrated in the accompanying FIGS. 1 through 3.

Referring now to FIG. 1, a preferred apparatus comprises an elongated handle portion 10 which attaches to one surface of a coupler 12, which preferably comprises a substantially flat plate 12 with rounded corners. The plate 12 is preferably generally rectangular in shape with a long dimension of preferably approximately nine to ten inches, most preferably about 9½ inches a short dimension of preferably approximately five to six inches, most preferably about 5½ inches, and a thickness of preferably approximately 1/16 to ¼ inches, most preferably approximately 3/16 inches. The handle 10 extends outward from the approximate center of one of the long sides of the plate 12 and may be fixed to the rear surface of the plate 12 in many ways familiar to those of ordinary skill in the art such as with screws or by snap fit. It may be most preferable to form both the handle 10 and plate 12 as a single solid plastic assembly. Referring now to FIG. 2, it may be desirable to utilize a thermoplastic material which is bendable by hand. The plastic may be bendable at room temperature, or be of a type which is bendable upon the application of a local heat source such as a portable heat gun. Suitable plastic materials with these properties are well known to those of skill in the art, and include, e.g. polyethylene and polyvinylchloride. The length and diameter of the handle 10 may vary widely, it being important only that it be reasonably comfortable to hold by hand and allow accessibility to the back and lower body with relative ease. It has been found most preferable for the handle to have a rectangular cross section with rounded corners, similar to a tennis racket handle. Handle 10 dimensions of approximately 16 to 20 inches in length, with a cross section of approximately ⅞ inches by ½ inches have been found suitable. Preferably, the longer sides of the handle cross sectional area are approximately parallel with the plane of the plate 12. It has also been found advantageous to taper the longer dimension of the handle cross section to be approximately ⅞ inches at the end gripped by the patient, and tapering down to about ⅝ inches near the plate 12. This makes the handle 10 more easily bent near the plate 12, when such bending is desired. The handle 10 may also be provided with an elongated hole 11 to allow hanging from a hook on a door or wall.

Referring back to FIG. 1, the plate 12 is provided with a first outer slot 14 parallel with and proximate to one of the short sides 22 of the plate 12. The slot extends most of the way along the breadth of the plate parallel to the short sides, having a length which is preferably approximately 3½ to 4 inches and width of approximately ½ to 1 inches. In one preferred embodiment, dimensions of 3¾ inches by ¾ inches has been found suitable. Proximate the other short side 18 of the plate 12 is provided a parallel second outer slot 20 of substantially equal length and width as the first slot 14, positioned substantially the same distance away from its proximate edge 18 as the first slot 14 is away from its proximate edge 22. The perpendicular distance between these first and second slots 14, 20 is preferably approximately 5 to 6 inches, most preferably approximately 5½ inches.

Also included in the preferred plate 12 of FIG. 1 are two inner elongated slots, designated 16 and 24. These two inner slots 16, 24 are each positioned parallel and adjacent to the previously described elongated slots 14 and 20 respectively, but closer to the center of the plate 12 than the outer slots 14, 20. As with the outer slots 14 and 20, the inner slots 16, 24 are of substantially equal size, with each being preferably about the same width as the outer slots 14, 20, but of shorter length. In one suitable embodiment, the inner slots 16, 24 are approximately 2½ to 3 inches long, most preferably 2¾ inches long, and are space apart approximately 4 to 5 inches, most preferably approximately 4½ inches. The preferred use of these slots will now be described in detail with reference to FIG. 3.

FIG. 3 illustrates the preferred long handled towel holder of FIG. 1 with a bath towel 30 placed through the slots 14, 20 so as to be held securely in place on the plate 12. The bath towel 30 is preferably a standard size bath towel or bath sheet, which is rectangular in shape and has dimensions greater than or equal to about 16 inches by 30 inches.

Prior to having an end threaded through one of the slots 14, 20, the bath towel 30 may be folded in half lengthwise as shown in FIG. 3. For most bath towels, the increase in thickness provided by this folding helps retain the bath towel 30 within the slots 14, 20. Preferably, one of the smaller ends of the folded bath towel 30 is threaded through the first outer elongated slot 14. Because the length of this slot 14 is preferably less than the width of the folded bath towel, the end of the bath towel must be bunched up in order to fit through the slot 14. The folds and creases in the bath towel 30 in the region of the slot 14 therefore hold the bath towel 30 by a friction fit within the confines of the slot 14. Although the bath towel 30 can be pulled through the slot 14 with the use of only one hand, the friction will retain the towel within the slot 14 during a normal drying process.

Following the insertion of one end of the bath towel 30 through the first elongated slot 14, the other end of the bath towel 30 is threaded through the other outer elongated slot 20 in a manner analogous to that described with respect to the first slot 14. Accordingly, intermediate portions of the bath towel 30 will be retained within each outer slot 14, 20 by a friction fit which holds the towel in place during drying.

The long handled bath towel holder of the present invention is made more convenient to use as a multi-purpose bathing implement with the provision of the two inner elongated slots 16, 24 described above in conjunction with FIG. 1. These two smaller elongated slots 16, 24 which are placed closer together on the plate 12 may be used to retain a washcloth in a similar manner as the bath towel can be retained in the outer elongated slots 14, 20. Use of this preferred embodiment therefore comprises affixing a wash cloth to the inner elongated slots 16, 24 as described above and washing difficult to reach portions of the body with the wash cloth. Following washing, a towel is placed in the outer elongated slots 14, 20 also in the manner described above, and various difficult to reach parts of the body may be dried with the same implement.

The foregoing description details certain preferred embodiments of the present invention and describes the best mode contemplated. It will be appreciated, however, that no matter how detailed the foregoing appears in text, the invention can be practiced in many ways. For example, slot dimensions may be varied within a wide range and remain suitable for use with the present invention. In addition, elastic bands or other towel retaining apparatus may be included if desired. Accordingly, the invention should be construed in accordance with the appended claims and any equivalents thereof.

What is claimed is:

1. A device for assisting a disabled person in drying themselves following bathing comprising a handle having a plate attached to one end, said plate comprising at least a first slot, a second slot, a third slot, and a fourth slot, said first slot proximate to a first side of said plate, said second slot proximate to a second side of said plate, said third slot adjacent to said first slot, said fourth slot adjacent to said second slot, said first and second slots having dimensions operative to securely accept a length of bath towel therethrough so as to hold said bath towel to said plate during drying, said third and fourth slots having dimensions operative to securely accept a length of washcloth therethrough so as to securely hold said washcloth to said plate during washing.

2. The device of claim 1 wherein said handle is bendable.

3. An apparatus for assisting a disabled person in drying themselves comprising:

an elongated handle;

a plate affixed to said elongated handle;

means for attaching a bath towel to said plate; and means, independent of said towel attaching means, for attaching a washcloth to said plate.

4. A device for drying difficult to reach areas of the body after bathing comprising:

a plate having first and second parallel and spaced apart elongated slots therethrough for securing a bath towel, said plate further having third and fourth parallel and spaced apart elongated slots therethrough for securing a washcloth;

a handle affixed to a surface of said plate; and a bath towel having first and second ends, wherein said first end of said bath towel is inserted through said first slot, wherein said second end of said towel is inserted through said second slot, and wherein portions of said bath towel intermediate said first and second ends are bunched within said first and second slots so as to hold said bath towel substantially in place during drying areas of the body.

5. The device of claim 4 wherein the ratio of length to width of said first and second slots is about 5:1.

6. The device of claim 5 wherein the length of said first and second slots is about 3½ to 4 inches.

7. The device of claim 6 wherein the dimensions of said bath towel are equal to or greater than about 16 inches by 30 inches.

8. The device of claim 4 wherein the dimensions of said bath towel are equal to or greater than about 16 inches by 30 inches.

* * * * *